US005738311A

United States Patent [19]

Fernandez

[11] Patent Number: 5,738,311

[45] Date of Patent: Apr. 14, 1998

[54] DISTRIBUTED POWER TRAIN SEPARATION DETECTION

[75] Inventor: Emilio A. Fernandez, Rockville, Md.

[73] Assignee: Westinghouse Air Brake Company, Wilmerding, Pa.

[21] Appl. No.: 799,882

[22] Filed: Feb. 13, 1997

[51] Int. Cl.[6] ..... B61L 3/00

[52] U.S. Cl. ..... 246/168; 246/187 C

[58] Field of Search ..... 246/167 R, 168, 246/169 R, 187 C; 364/424.03; 340/901

[56] References Cited

U.S. PATENT DOCUMENTS

| | | | |
|---|---|---|---|
| 1,286,743 | 12/1918 | Ostrowski | 246/168 |
| 1,321,685 | 11/1919 | Vallaro | 246/168 |
| 1,656,689 | 1/1928 | Benn et al. | 246/168 |
| 1,918,231 | 7/1933 | Chesnutt | 246/268 |

FOREIGN PATENT DOCUMENTS

| | | | |
|---|---|---|---|
| 2225887 | 6/1990 | United Kingdom | 246/168 |

*Primary Examiner*—S. Joseph Morano

*Attorney, Agent, or Firm*—Whitham, Curtis, Whitham & McGinn

[57] ABSTRACT

A train separation detector for a distributed power control system in railroad trains uses the distance traveled input from an axle drive generator or similar device to compute the speed of the lead locomotive and the speed of the remote locomotives and also the distance traveled by the lead locomotive and the remote locomotives per unit of time. Normally, both the distance traveled and the speed of the lead and remote locomotives will, on average, be the same since they are in the same train. If there is a separation, however, both the distance traveled and the speed of the lead and remote locomotives will be different to the extent that there is a train separation. By comparing the speed and distance traveled of the lead and remote locomotives, the distributed power system will be able to detect train separation and take appropriate action.

8 Claims, 3 Drawing Sheets

DISTRIBUTED POWER TRAIN SEPARATION DETECTION

DESCRIPTION

BACKGROUND OF THE INVENTION

1. Field of the Invention

The present invention generally relates to improvements in railroad control systems and, more particularly, to detection of a separation condition between a lead locomotive and multiple remote locomotives in a distributed power control operation.

2. Background Description

Distributed power control systems in railroad trains have been developed for use in trains having multiple helper or remote locomotives separated from the lead locomotive by a number of freight cars. The remote locomotives may also be separated from one another by a number of freight cars. Normally, when two locomotives are directed connected together, communication between the two locomotives for purposes of controlling the trailing locomotive from the lead locomotive is through the multiple unit or MU cable. However, when freight cars separate the locomotives, this communication link is not available.

Distributed power control systems typically include a plurality of radio frequency (RF) communication modules mounted in respective ones of the locomotives in a train. Communication between the lead locomotive to the remote locomotives is effected by a protocol of command and status messages transmitted between the communication modules.

Freight trains can be more than a mile long, and the train crew does not have complete visual contact with the total length of the train. Therefore, a train separation between the one of the remote locomotives and that portion of the train ahead of the remote locomotive could take place without the train crew observing that condition. Current distributed power systems rely on the monitoring of brake pipe pressure and brake pipe air flow to detect abnormal operating conditions, like a train separation. Existing systems rely on the fact that a train separation normally results in a separation of the brake pipe which will result in brake pipe air exhausting to atmosphere. Since existing systems monitor brake pipe pressure and brake pipe air flow, existing systems can infer a train separation condition by the changes in these parameters and take appropriate action to insure safe operation in these circumstances. Appropriate action might be alerting the operator of the condition and setting the remote locomotive throttle controls to idle.

The current systems work well except in cases when there is a blockage in the brake pipe that allows the remote locomotive to separate from the rest of the train without affecting the brake pipe pressure and air flow. Such is the case when, due either to vandalism or to operator error, one or more of the brake pipe angle cocks that are between the remote locomotive and the rest of the train are closed. This has actually happened in a case in which the remote locomotive separated from the lead locomotive and for some part of the trip until the condition was detected there was a considerable separation, on the order of miles. Such a condition can, of course, be extremely dangerous.

SUMMARY OF THE INVENTION

It is therefore an object of the present invention to provide a train separation detector for a distributed power control system in railroad trains.

According to the invention, the lead locomotive and the remote locomotives use the distance traveled input from an axle drive generator or similar device to compute the speed of the lead locomotive and the speed of the remote locomotives and also the distance traveled by the lead locomotive and the remote locomotives per unit of time. Of course, both the distance traveled and the speed of the lead and remote locomotives will, on average, be the same since they are in the same train. If there is a separation, however, both the distance traveled and the speed of the lead and remote locomotives will be different to the extent that there is a train separation. By comparing the speed and distance traveled of the lead and remote locomotives, the distributed power system will be able to detect train separation and take appropriate action.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
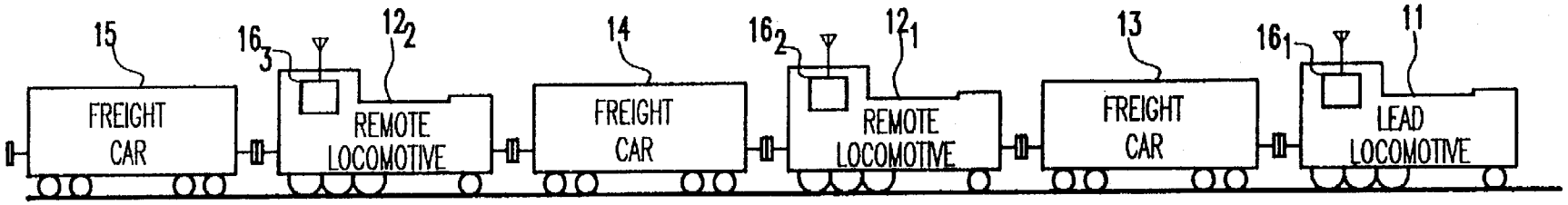
FIG. 1 is a block diagram of a distributed power control system of the type on which the invention may be implemented.

Referring now to the drawings, and more particularly to FIG. 1, there is shown a train which includes a lead locomotive 11 and multiple remote locomotives $\mathbf{12_1}$ and $\mathbf{12_2}$ separated by a plurality of freight cars 13, 14 and 15. Each of the locomotives 11, $\mathbf{12_1}$ and $\mathbf{12_2}$ are equipped with an RF communication and control module, generally shown as $\mathbf{16_1}$, $\mathbf{16_2}$ and $\mathbf{16_3}$. The communication and control module $\mathbf{16_1}$ of the lead locomotive is programmed to act as the lead unit, and the communication and control modules $\mathbf{16_2}$ and $\mathbf{16_3}$ of the remote locomotives being programmed to act as remote units for purposes of the distributed power control protocol. These are interchangeable so that if, for example, remote locomotive $\mathbf{12_1}$ were to be used as the lead locomotive in another train, its communication and control module $\mathbf{16_2}$ could be appropriately programmed to act as the lead unit for that train.

Figure 2:
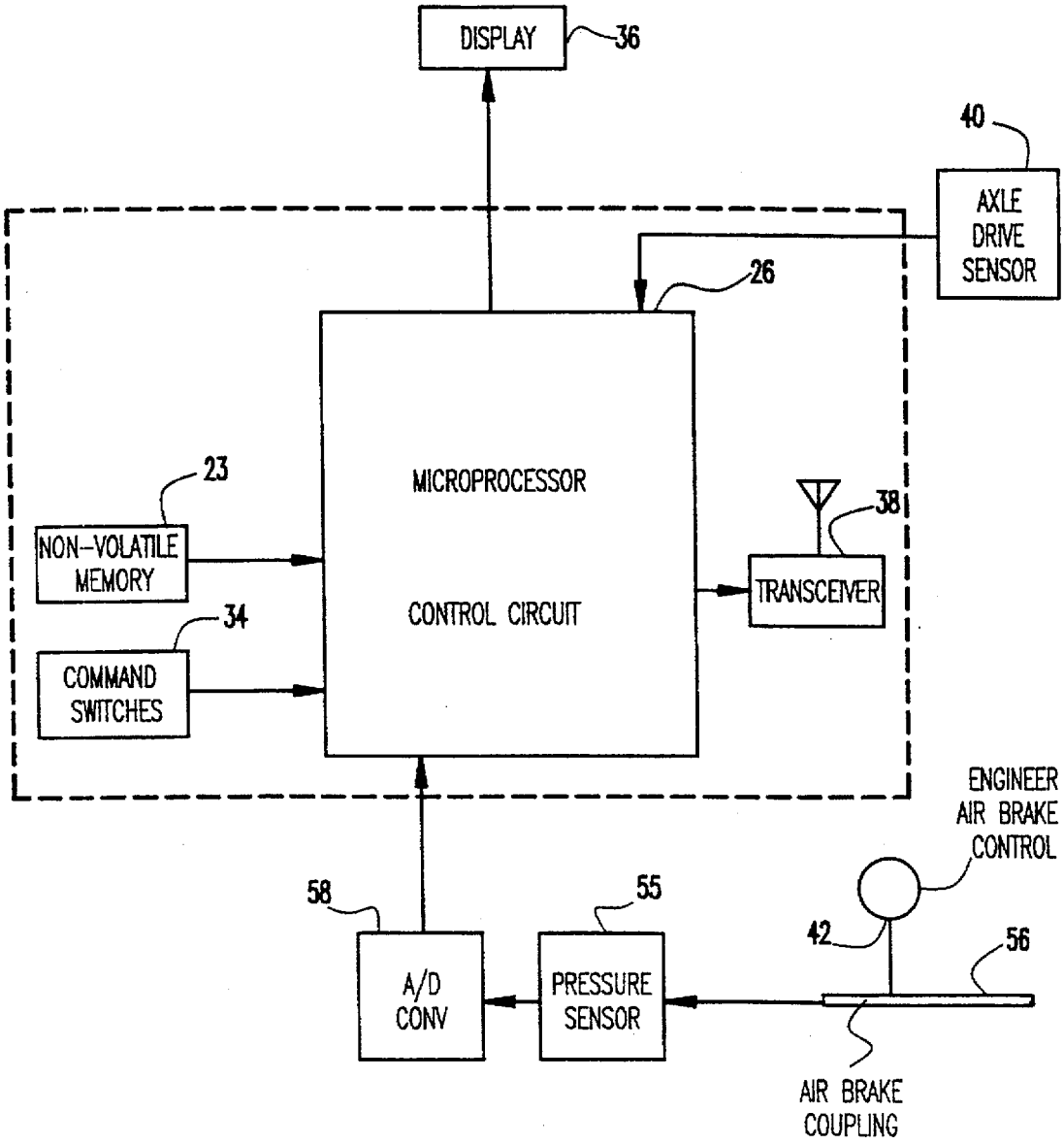
FIG. 2 is a block diagram of the basic components of a communications module as mounted in each of the lead and remote locomotives of the distributed power control system.

The locomotive control and communication module is shown in FIG. 2 and includes microprocessor control circuit 26 and a nonvolatile memory 28 which stores the control program for the microprocessor control circuit. In addition to nonvolatile memory 28, the microprocessor control circuit 26 also has a command switch input 34 and provides outputs to a display 36 and transceiver 38.

A locomotive engineer controls air brakes via the normal locomotive air brake controls, indicated schematically at 42, and the normal air brake pipe 56 which extends the length of the train. Existing communication and control modules are connected to the locomotive's axle drive via an axle drive sensor 40 which provides typically twenty pulses per wheel revolution. Based on this input, the microprocessor driven control circuit 26 computes the locomotive's speed and distance traveled.

In addition, there is typically a pressure sensor 55 to which is coupled to the brake pipe 56 at the locomotive and generates an electrical signal proportional to pressure. The output of pressure sensor 55 is coupled to an analog to digital converter 58 which generates a digital signal to the microprocessor control circuit 26 so that changes in brake pressure at the locomotive end of the brake pipe are coupled to the microprocessor control circuit 26.

According to the present invention, the remote locomotives transmit as part of their status messages their computed speed and distance traveled. The computation of both speed and distance traveled is averaged over a short predetermined time to account for naturally occurring variations due to slack or take up of slack in the train. In addition, prior to the regular computation and transmission of this information, each locomotive, including the lead locomotive, a calibration procedure must be completed. Such a calibration procedure is routine and takes into account the fact that locomotive wheels have differing diameters due to wear and machining.

Figure 3:
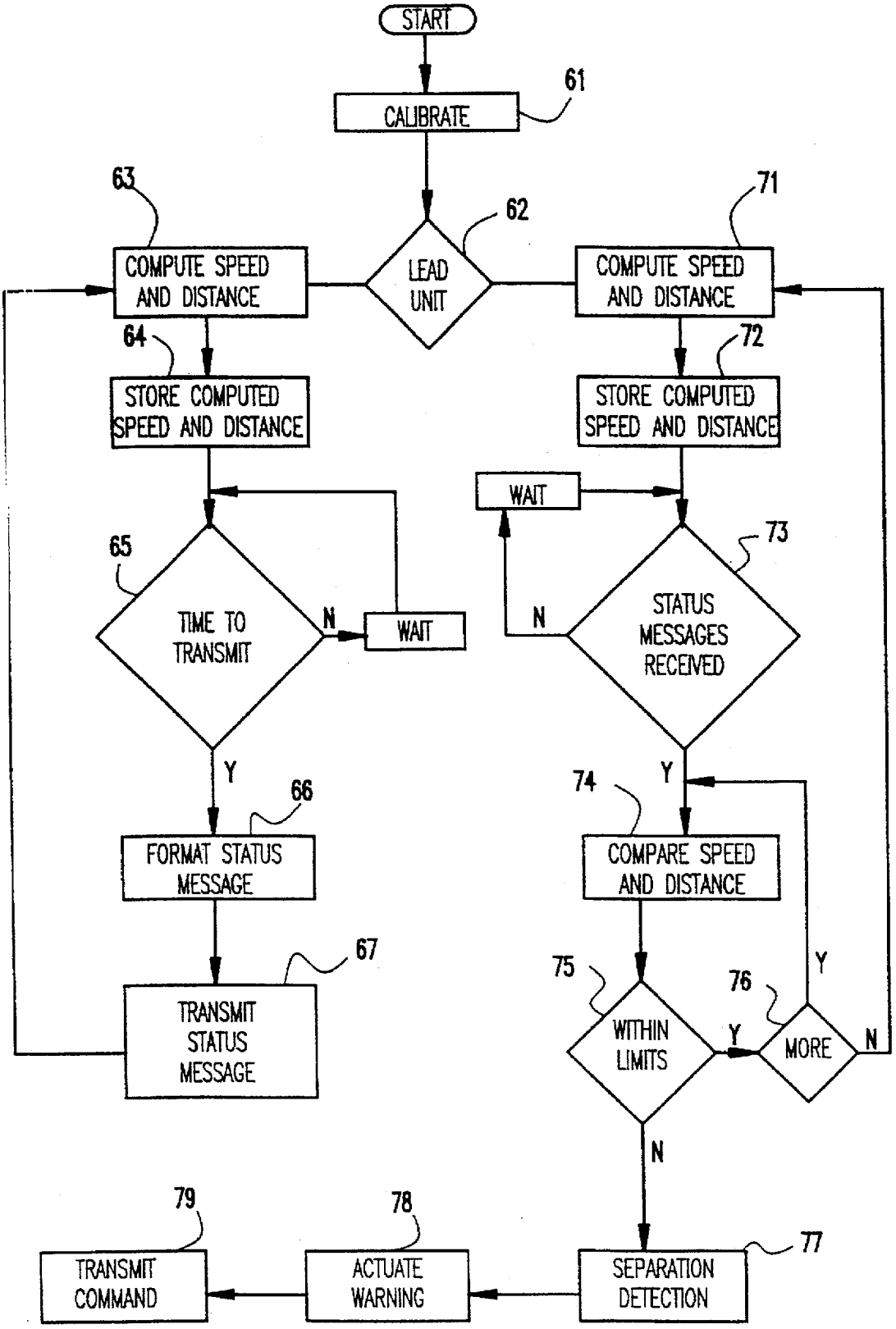
FIG. 3 is a flow diagram illustrating the logic of the train separation detector according to the invention.

The flow diagram of the logic for the train separation detector is shown in FIG. 3. The process begins by performing the calibration procedure in function block 61. Once calibrated, a test is made in decision block 62 to determine whether this communication and control unit is programmed as the lead unit or the remote unit. If programmed as the remote unit, a computation of current speed and distance traveled is made in function block 63. The computed speed and distance traveled data is stored in function block 64, and a test is made in decision block 65 to determine if it is time to transmit a status message. Such a message may be transmitted either periodically or in response to a command message from the lead unit. When it is time to transmit a status message, the stored speed and distance traveled data is formatted in the status message in function block 66, and the status message is transmitted to the lead unit in function block 67. At this point, the process loops back to function block 63 to again compute the current speed and distance traveled.

If the communication and control unit is programmed as the lead unit, as determined in decision block 62, then a computation of current speed and distance traveled is made in function block 71, and the computed speed and distance traveled data is stored in function block 72. A test is made in decision block 73 to determine if the status messages have been received from the remote locomotives. When the status messages have been received, the speed and distance traveled data from each remote locomotive is extracted from the status messages. The stored speed and distance traveled for the lead locomotive is compared in turn with each of the speed and distance traveled data extracted from the status messages in function block 74. A test is made after each comparison in decision block 75 to determine if the comparison is within predefined limits. If so, a determination is made in decision block 76 to determine if another comparison is to be made and, if so, the process loops back to function block 74; otherwise, the process loops back to function block 71 to compute the current speed and distance traveled. If, however, one of the comparisons is not within limits as determined in decision block 75, a separation condition is detected in function block 77. As a result, the operator of the lead locomotive is alerted by means of visible and/or audible warning in function block 78. A status message may also be displayed on display 36 (FIG. 2). Appropriate action may then be taken. This may take the form of transmitting a command message in function block 79 to the remote locomotive(s) which follow the separation in the train to set their throttle controls to idle and applying the brakes of the trailing separated portion of the train. This will allow the leading separated portion of the train to independently and safely stop and reverse to make the connection to the trailing portion of the train without the possibility of a collision between the two portions.

The preferred embodiment of the invention may be modified to compare only speed or only distance traveled of the lead and remote locomotives. This would have the advantage of minimizing the additional information transmitted in the status message and, if only speed is computed, minimizing the computation time of the microprocessor control circuits. Thus, while the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A train separation detector for a distributed power system in a railroad train having multiple locomotives separated by a plurality of freight cars, said train separation detector comprising:

a first communication and control unit in a lead locomotive of the railroad train, said first communication and control unit including a first microprocessor control circuit and a first transceiver, the first microprocessor control circuit periodically computing speed for the lead locomotive and the first transceiver periodically receiving status messages from remote locomotives; and a second communication and control unit in a remote locomotive of the railroad train, the second communication and control unit including a second microprocessor control circuit and a second transceiver, the second microprocessor control circuit periodically computing speed for the remote locomotive and the second transceiver periodically transmitting computed speed of the remote locomotive as a part of status messages to the first transceiver, the first microprocessor control circuit of the first communication and control unit comparing a speed received in a status message from the remote locomotive to the computed speed of the lead locomotive and, if the comparison is not within predetermined limits, declaring a train separation.

2. The train separation detector for a distributed power system as recited in claim 1 wherein the first microprocessor control circuit additionally computes distance traveled for the lead locomotive, the second microprocessor additionally computes distance traveled for the remote locomotive, the computed distance traveled for the remote locomotive being transmitted in the status message, and the distance traveled received in the status message from the remote locomotive is compared by the first microprocessor control circuit with the computed distance traveled of the lead locomotive and, if the comparison is not within predetermined limits, the first microprocessor control circuit declares a train separation.

3. The train separation detector as recited in claim 1 further comprising calibration means in each of the lead and remote locomotives for calibrating speed computed by the first and second communication and control units.

4. A train separation detector for a distributed power system in a railroad train having multiple locomotives separated by a plurality of freight cars, said train separation detector comprising:

a first communication and control unit in a lead locomotive of the railroad train, said first communication and control unit including a first microprocessor control circuit and a first transceiver, the first microprocessor control circuit periodically computing speed for the lead locomotive and the first transceiver periodically receiving status messages from remote locomotives; and a second communication and control unit in a remote locomotive of the railroad train, the second communication and control unit including a second microprocessor control circuit and a second transceiver, the second microprocessor control circuit periodically computing speed for the remote locomotive and the second transceiver periodically transmitting computed speed of the remote locomotive as a part of status messages to the first transceiver, the first microprocessor control circuit of the first communication and control unit comparing a speed received in a status message from the remote locomotive to the computed speed of the lead locomotive and, if the comparison is not within predetermined limits, declaring a train separation.

5. A train separation detector for a distributed power system in a railroad train having multiple locomotives separated by a plurality of freight cars, said train separation detector comprising:

a first communication and control unit in a lead locomotive of the railroad train, said first communication and control unit including a first microprocessor control circuit and a first transceiver, the first microprocessor control circuit periodically computing speed and distance traveled for the lead locomotive and the first transceiver periodically receiving status messages from remote locomotives; and a second communication and control unit in a remote locomotive of the railroad train, the second communication and control unit including a second microprocessor control circuit and a second transceiver, the second microprocessor control circuit periodically computing speed and distance traveled for the remote locomotive and the second transceiver periodically transmitting computed distance traveled of the remote locomotive as a part of status messages to the first transceiver, the first microprocessor control circuit of the first communication and control unit comparing a distance traveled received in a status message from the remote locomotive to the computed distance traveled of the lead locomotive and, if the comparison is not within predetermined limits, declaring a train separation.

6. A method of detecting a train separation condition in a distributed power system in a railroad train having multiple locomotives separated by a plurality of freight cars comprising the steps of:

periodically computing at a lead locomotive of the railroad train speed for the lead locomotive;

storing the computed speed for the lead locomotive;

periodically computing at a remote locomotive of the railroad train speed for the remote locomotive;

storing the computed speed for the remote locomotive;

transmitting the stored speed for the remote locomotive to the lead locomotive;

comparing the transmitted stored speed for the remote locomotive with the stored speed for the lead locomotive;

determining if the compared speed for the remote and lead locomotives are within predetermined limits; and if not within predetermined limits, declaring a train separation.

7. The method of detecting a train separation condition in a distributed power system as recited in claim 6 further comprising the steps of:

computing distance traveled for the lead locomotive;

computing distance traveled for the remote locomotive;

transmitting the computed distance traveled for the remote locomotive to the lead locomotive;

comparing the distance traveled received for the remote locomotive with the computed distance traveled for the lead locomotive; and, if the comparison is not within predetermined limits, declaring a train separation.

8. The method of detecting a train separation condition in a distributed power system as recited in claim 6 further comprising the step of calibrating speed computed at each of the lead and remote locomotives.

* * * * *